US006278320B1

(12) United States Patent
Vu

(10) Patent No.: US 6,278,320 B1
(45) Date of Patent: Aug. 21, 2001

(54) LOW NOISE HIGH PSRR BAND-GAP WITH FAST TURN-ON TIME

(75) Inventor: Luan Vu, San Jose, CA (US)

(73) Assignee: National Semiconductor Corporation, Santa Clara, CA (US)

( * ) Notice: Subject to any disclaimer, the term of this patent is extended or adjusted under 35 U.S.C. 154(b) by 0 days.

(21) Appl. No.: 09/465,992

(22) Filed: Dec. 16, 1999

(51) Int. Cl.[7] ..... G05F 1/10
(52) U.S. Cl. ..... 327/539; 327/540; 327/552
(58) Field of Search ..... 327/552, 539, 327/540, 554, 543

(56) References Cited

U.S. PATENT DOCUMENTS 3,887,863 6/1975 Brokaw ..... 323/19
4,823,070 * 4/1989 Nelson ..... 323/285
5,892,381 * 4/1999 Koifman et al. ..... 327/198

* cited by examiner

*Primary Examiner*—Toan Tran
*Assistant Examiner*—Cassandra Cox
(74) *Attorney, Agent, or Firm*—Beyer Weaver & Thomas, LLP

(57) ABSTRACT

A band-gap filter circuit is disclosed for use in a voltage regulator. A capacitor charger (or "cap charger") circuit quickly charges a filter capacitor when power is applied to the voltage regulator circuit. At start-up, the cap charger begins charging the filter capacitor. Once an output node equals or nearly equals the voltage at the input node, the cap charger shuts off. The circuit provides a very fast turn-on time, reaching 95% of its steady state value within 200 microseconds, thus overcoming the long turn-on times associated with other designs. The present invention may be utilized in power sensitive applications, such as cellular telephones, that wish to shut off the voltage regulator in order to conserve power.

13 Claims, 5 Drawing Sheets

LOW NOISE HIGH PSRR BAND-GAP WITH FAST TURN-ON TIME

BACKGROUND OF THE INVENTION

1. Field of the Invention

The present invention relates generally to the field of band-gap voltage references, and more particularly to a low noise, high PSRR (power supply rejection ratio) band-gap reference having a fast turn-on time.

2. Description of the Related Art

The basic operation of band-gap circuits is well known in the art. For example, a Brokaw band-gap core is disclosed in U.S. Pat. No. 3,887,863, the disclosure of which is herein incorporated by reference. A band-gap core generally comprises a pair of transistors, which generate a voltage proportional to absolute temperature (PTAT). A network of resistors is connected to the transistors to multiply the PTAT voltage and add the voltage to the base-emitter voltage of one of the transistors, such that the total voltage is constant over temperature. The band-gap core circuit thus provides a temperature compensated reference voltage output.

Many applications, such as a low drop-out (LDO) voltage regulator, need to have low noise characteristics and also have a high PSRR (power supply rejection ratio). The main source of both noise and PSRR in a voltage regulator is from the band-gap circuit. As shown in FIG. 1, a large value capacitor 14 (≧10 nF) has been used in prior art circuits to filter the noise from the band-gap 10 from the rest of the circuit 12. Many applications, though, further require a fast "turn-on" time (i.e. the time it takes for the circuit to stabilize the output voltage after being turned on). For example, in cellular telephones, many manufacturers wish to periodically turn off the voltage regulator in order to conserve battery power. If the turn-on time is too large, however, it is not practical to shut off the regulator since this would interrupt the use of the cellular telephone. Since inserting a large capacitor to filter the noise significantly increases the "turn-on" time for the voltage regulator, the solution of FIG. 1 is not preferred for the cellular telephone market and other similar applications.

Thus, it would be desirable to have a low noise, high PSRR band-gap circuit that has a fast turn-on time and that can be incorporated into a voltage regulator or other circuits utilizing a band-gap reference.

SUMMARY OF THE INVENTION

The present invention provides a capacitor charger (or "cap charger") circuit to quickly charge a filter capacitor when power is applied to a voltage regulator circuit or other similar circuit. The output of a typical band-gap circuit is connected to an input node. A resistor connects the input node to a large filter capacitor, forming an RC filter network. The resistor isolates the filter capacitor from the input node. A comparator circuit has one input connected to the filter capacitor and a circuit output node and a second input connected to the input node. An output of the comparator connects to a gate of a MOS transistor, which is configured to operate as a switch.

At start-up, the comparator is on since the input values are different. The MOS switch is then turned on which charges up the filter capacitor. Once the output node equals or nearly equals the voltage at the input node, the comparator shuts off the transistor switch.

The input terminal of the comparator that is connected to the input node may be set to a predetermined voltage value that is slightly less than the input voltage, in order to compensate for circuit latencies and offsets. The circuit provides a very fast turn-on time, reaching 95% of its steady state value within 200 microseconds. This "turn-on" time may be changed by adjusting the value of a current source used to charge the capacitor. Thus, the present invention may be utilized in power sensitive applications, such as cellular telephones, that wish to shut off the voltage regulator circuit in order to conserve power.

BRIEF DESCRIPTION OF THE DRAWINGS

The present invention will be readily understood by the following detailed description in conjunction with the accompanying drawings, wherein like reference numerals designate like structural elements, and in which.

DETAILED DESCRIPTION OF THE INVENTION

The following description is provided to enable any person skilled in the art to make and use the invention and sets forth the best modes contemplated by the inventor for carrying out the invention. Various modifications, however, will remain readily apparent to those skilled in the art, since the basic principles of the present invention have been defined herein specifically to provide to a low noise, high PSRR (power supply rejection ratio) band-gap reference having a fast turn-on time, suitable for use in a low power applications.

Figure 5:
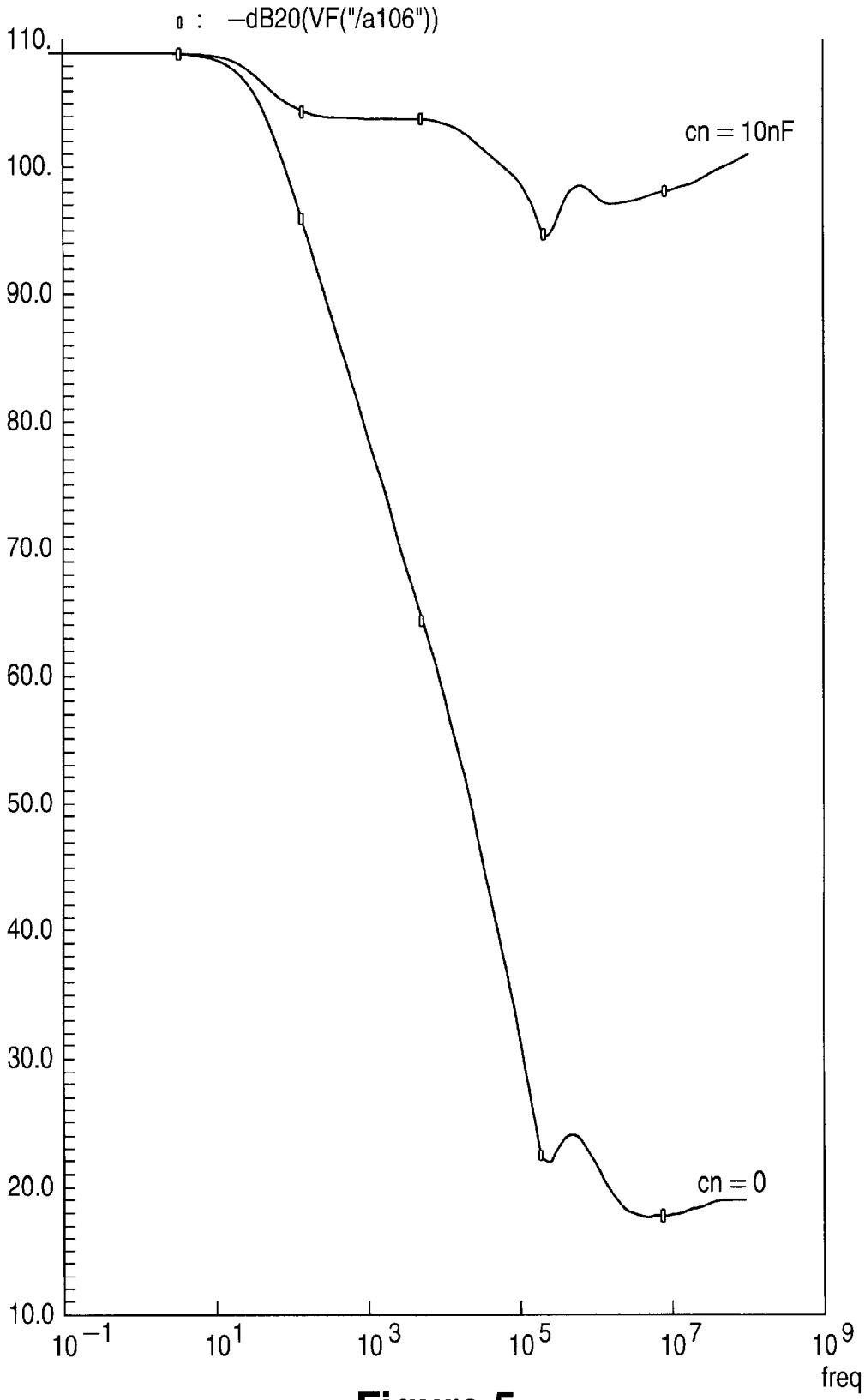
FIG. 5 is a graph of the PSRR versus frequency for a band-gap having a filter capacitor as disclosed in the present invention, and a band-gap without the filter capacitor.

In general, a high performance band-gap circuit suitable for applications such as cellular telephones needs to have a high PSRR and low noise. The PSRR is a ratio of the change in input power supply voltage over the change in band-gap output voltage (the higher the better). In other words, the smaller the variation in the output voltage of the band-gap, the better the performance of the circuit. Designing a circuit with a high PSRR for low frequencies (nominal DC) is generally not difficult, but at higher frequencies capacitive coupling in the circuit couples the power supply to the output, which significantly reduces the PSRR. This is illustrated in the graph of FIG. 5. For low frequencies, the PSRR for a typical band-gap circuit could be as high as 100 dB. Depending on the band-gap architecture, however, the PSRR rolls off for a typical band-gap (Cn=0) at frequencies as low as 10–100 Hz. For RF applications, it would be desirable to have a high PSRR (50–70 dB) at higher frequencies (50 kHz), compared to the 20 dB of a typical band-gap. Note that the addition of a 10 nF capacitor greatly increases the PSRR of the band-gap over the entire frequency range (PSRR>90 dB). The RC filter introduces a pole at ($1/[2\pi R_{eq}Cn]$) to the gain path from the power supply to the band-gap output (where $R_{eq}$=R10+$r_o$(band-gap output impedance)). This is equivalent to introducing a zero to the PSRR at the same frequency.

Figure 6:
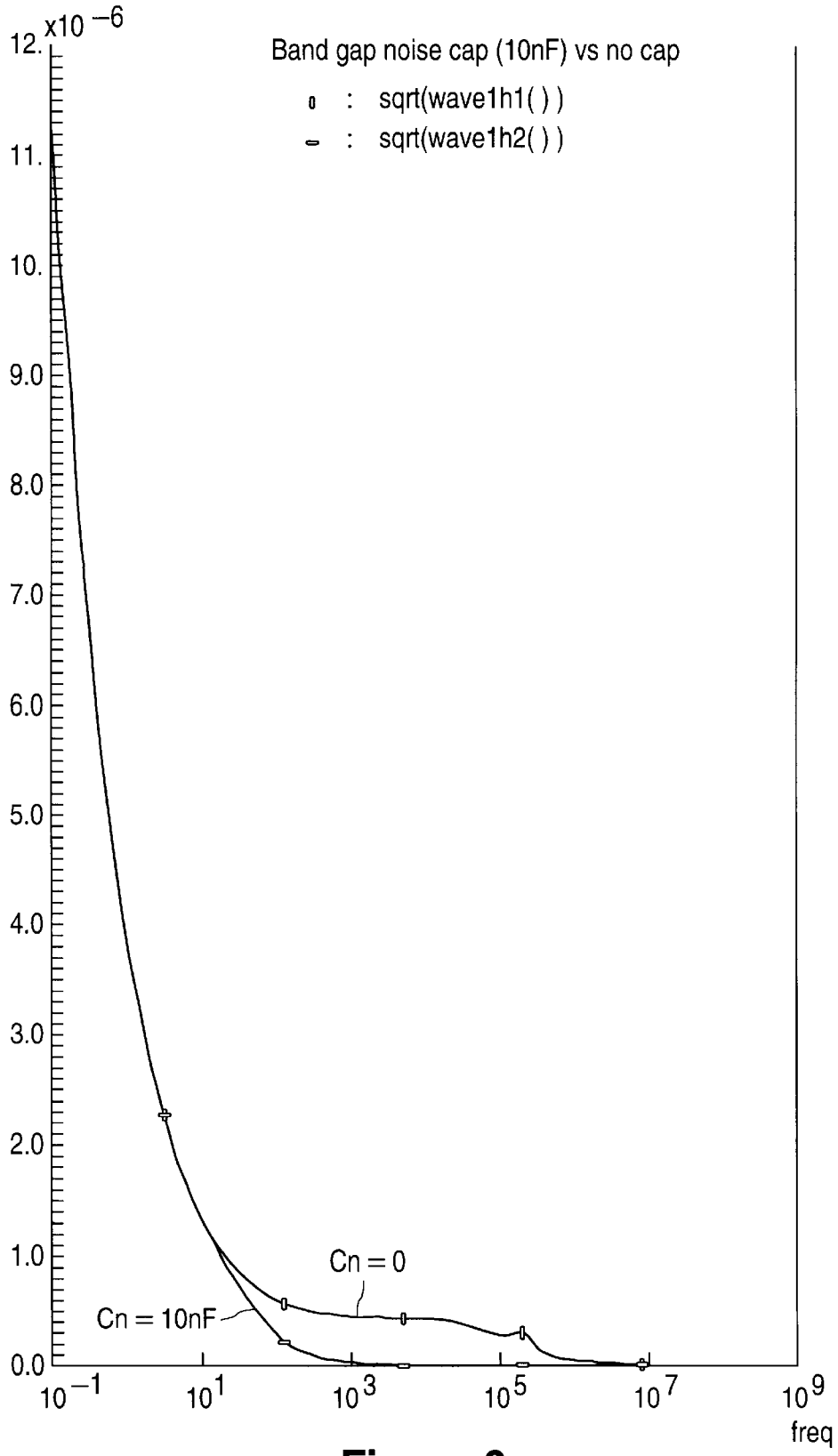
FIG. 6 is a graph of the noise versus frequency for a band-gap having a filter capacitor as disclosed in the present invention, and a band-gap without the filter capacitor.

The noise characteristics of a typical band-gap circuit are illustrated by the graph of FIG. 6. The noise component at low frequencies is caused primarily by flicker (1/f) noise, whereas the noise component at higher frequencies is caused primarily by thermal noise. The addition of a 10 nF capacitor significantly reduces the noise components at frequencies $\geqq(1/[2\pi R_{eq}Cn])$, and in fact, basically reduces the noise close to 0 dB at 100 Hz.

Figure 1:
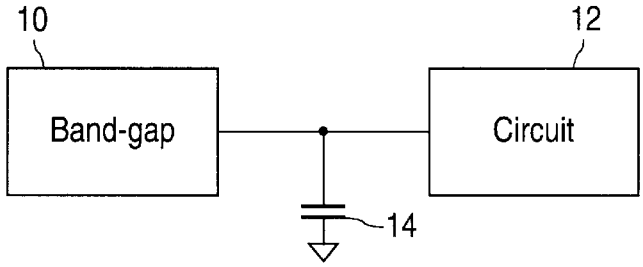
Figure 1 (PRIOR ART)
FIG. 1 is a block diagram of a prior art voltage regulator.
Figure 2:
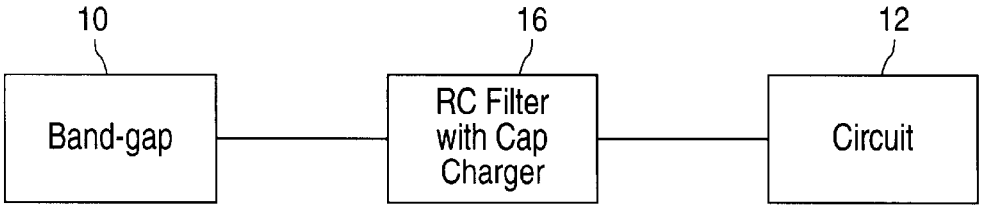
FIG. 2 is a block diagram of the present invention.

Since the output impedance of a typical band-gap circuit is very high, it takes a long time to charge up the capacitor (on the order of 20 milliseconds for a 10 nF capacitor). Thus, the addition of the capacitor greatly increases the turn-on time (and turn-off time) for the band-gap circuit, since the large capacitance must charge and discharge each time the circuit is powered on and off, respectively. Adding a smaller capacitor would help, but the capacitance needs to be large enough to move the filter pole down to a low enough frequency to effectively filter out the noise and recover the PSRR to a desired level. In order to overcome this problem, the present invention provides a capacitor charger (or "cap charger") circuit to quickly charge the capacitor when power is applied to the voltage regulator circuit. As illustrated in FIG. 2, an RC filter and a cap charger circuit 16 may be coupled between an output of the band-gap circuit 10 and the rest of the circuit 12. The circuit 12 could be an LDO circuit or any other circuit that requires a low noise, high PSRR reference.

Figure 3:
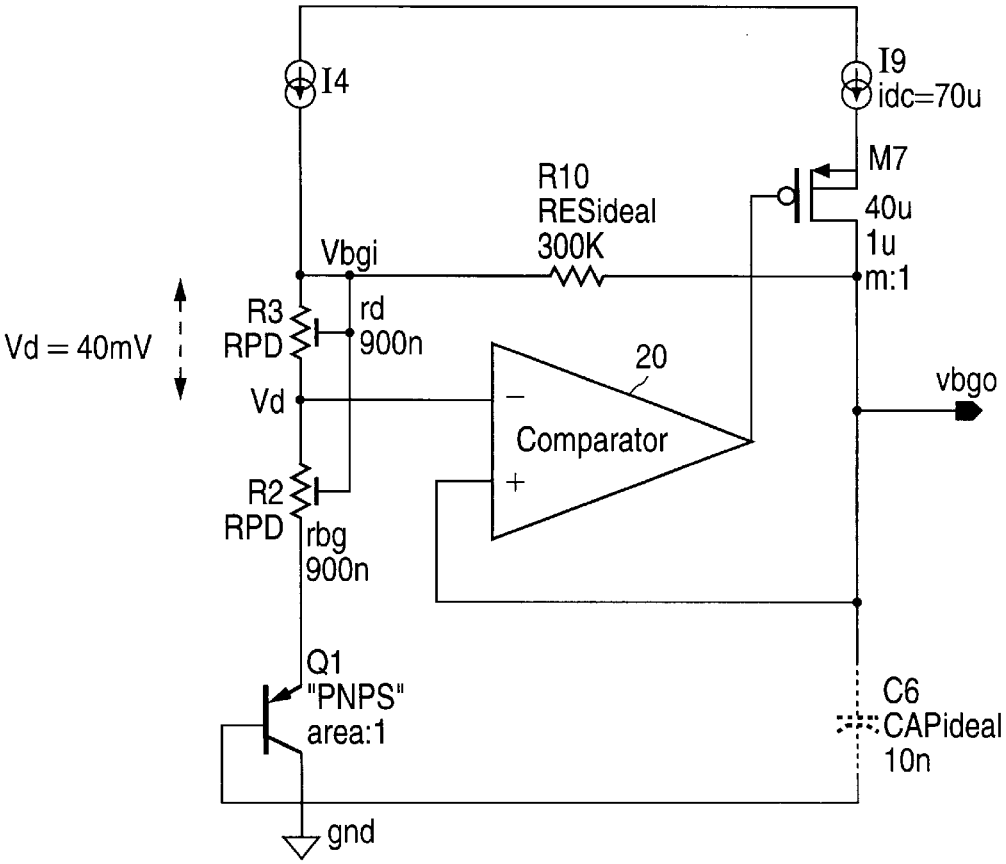
FIG. 3 is a schematic circuit diagram of an embodiment of the present invention.
Figure 4:
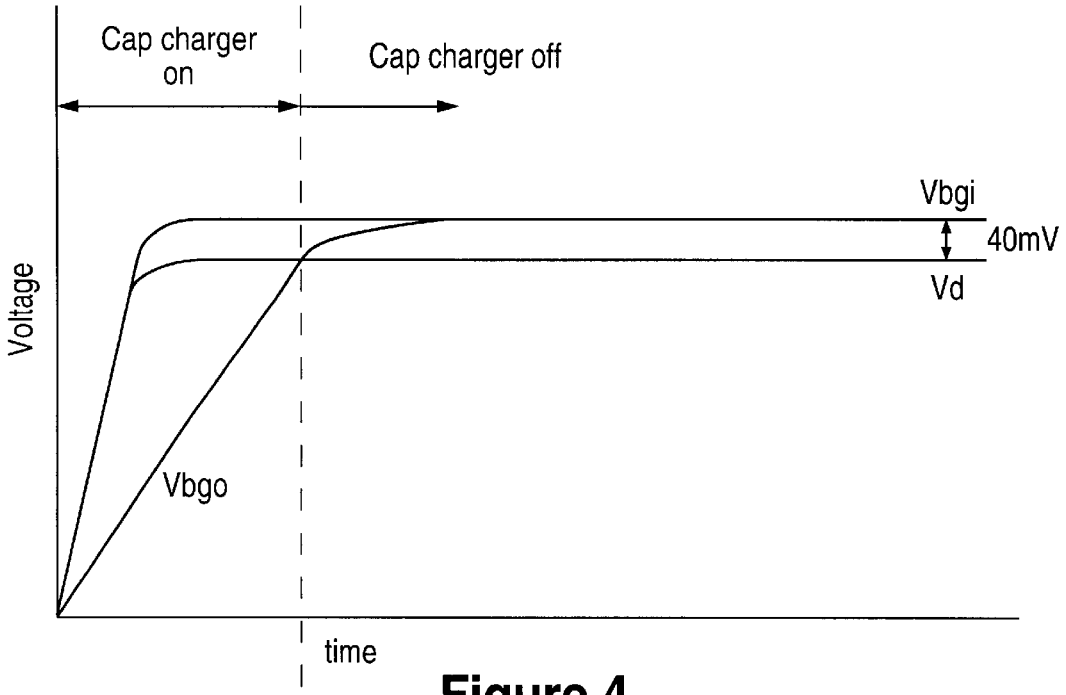
FIG. 4 is a graph illustrating the operation of the circuit of FIG. 3.

A detailed schematic of one embodiment of the present invention is illustrated in FIG. 3. The output of a typical band-gap circuit (not shown) is connected at the Vbgi node. A resistor R10 connects the output of the band-gap to a large filter capacitor C6, forming an RC filter network. A second resistor R3 connects the output of the band-gap to a negative input terminal of a comparator 20. A positive terminal of the comparator 20 connects to the filter capacitor C6 and a circuit output node Vbgo. An output of the comparator 20 connects to a gate of a PMOS transistor M7, which is configured to operate as a switch. The comparator 20 turns on the transistor switch M7 if Vd>Vbgo. The PTAT current source I4, along with the resistors R2, R3 and a transistor Q1 generate the band-gap voltage: $V_{BG}=V_{BEQ1}+I4*(R2+R3)$.

Initially, at start-up, Vbgi will reach a steady state very quickly, (typically within less than 50 microseconds). The relatively large resistor R10 (typically 300 KΩ) isolates the capacitor C6, thereby allowing the Vbgi node to reach a steady state without having to charge the capacitor C6. The large resistance R10 also increases the output impedance (as viewed from the capacitor C6) of the band-gap circuit, which also helps move the filter pole to a lower frequency (i.e. pole is at $1/[2\pi RC]$). The value of the resistor R3 connected to the negative terminal of the comparator 20 is selected so that the voltage Vd at the terminal is approximately 40 mV less than Vbgi. Since the voltage on the positive terminal of the comparator at start-up is nominally zero (i.e. only a few millivolts depending on the circuit biasing), the comparator turns on and supplies a signal to the gate of the PMOS transistor M7.

The PMOS transistor M7 then turns on and provides a current from the constant current source I9 that charges the capacitor C6. Without the current source I9, the capacitor C6 could charge from the supply source Vdd, but the charge time would be dependent on temperature, process and/or voltage. With a constant current source I9, the charge time can be controlled very accurately. The charge time is calculated by $I=C*(\Delta v/\Delta t)$ or $[\Delta t=(C*V_{BG})/I9]$. As the capacitor C6 charges, node Vbgo approaches the voltage value of Vbgi. The Vbgo node may be connected to a voltage regulator circuit, or similar circuit that is expecting a band-gap output voltage.

Once the inputs to the comparator 20 are equal (i.e. Vbgo=Vd), the comparator turns off the transistor switch M7. At this point, Vbgo will be about 40 mV less than Vbgi. There generally will be a slight overshoot, since there will be some small latency through the comparator to turn off the transistor switch M7. Also, since there is a current path through R10 form the band-gap, C6 will eventually charge up to match Vbgi. The comparator definitely needs to be turned off before the Vbgo voltage reaches the final steady state value, otherwise if the voltage on the capacitor C6 gets too large, it will overshoot the Vbgi voltage and drive current into the band-gap circuit. Also, if M7 remains on, the noise from the power supply will couple onto the output line and the PSRR will increase.

In this embodiment, the input to the comparator is set to be 40 mV less than Vbgi for two reasons. First, since there will be some overshoot of the value of Vbgo due to the latency of turning off the transistor switch M7, the input to the comparator should be a little lower in order to prevent Vbgo from overshooting Vbgi. If the value of Vbgi is passed, it takes time to discharge the capacitor due to the high impedance looking back into R10. Therefore it is better to undershoot the final desired value of Vbgo, and allow the residual current path through R10 to finish charging the capacitor C6. Also, the comparator 20 is not ideal and has its own offset errors. The offset could be reduced by incorporating a sophisticated comparator, but that would require more area on the chip (i.e. a relative large comparator). Thus, in order to keep the size of the comparator 20 small, a comparator design is chosen having a maximum 10–20 mV offset. Since the offset error in the comparator could cause Vbgo to overshoot by 10–20 mV, the input Vd is set low enough to compensate for the offset error in the comparator 20 plus the error caused by the turn-off time.

As described herein, the value of Vd may be adjusted to any predetermined value to suit the needs of a particular circuit design. For example, with an ideal comparator, Vd could be set to as high as 10 mV lower than Vbgi. For a very slow comparator and transistor switch M7, the value of Vd could be set lower. Note that since there is a residual current path through R10, the value of Vbgo will ultimately equal Vbgi.

Figure 7:
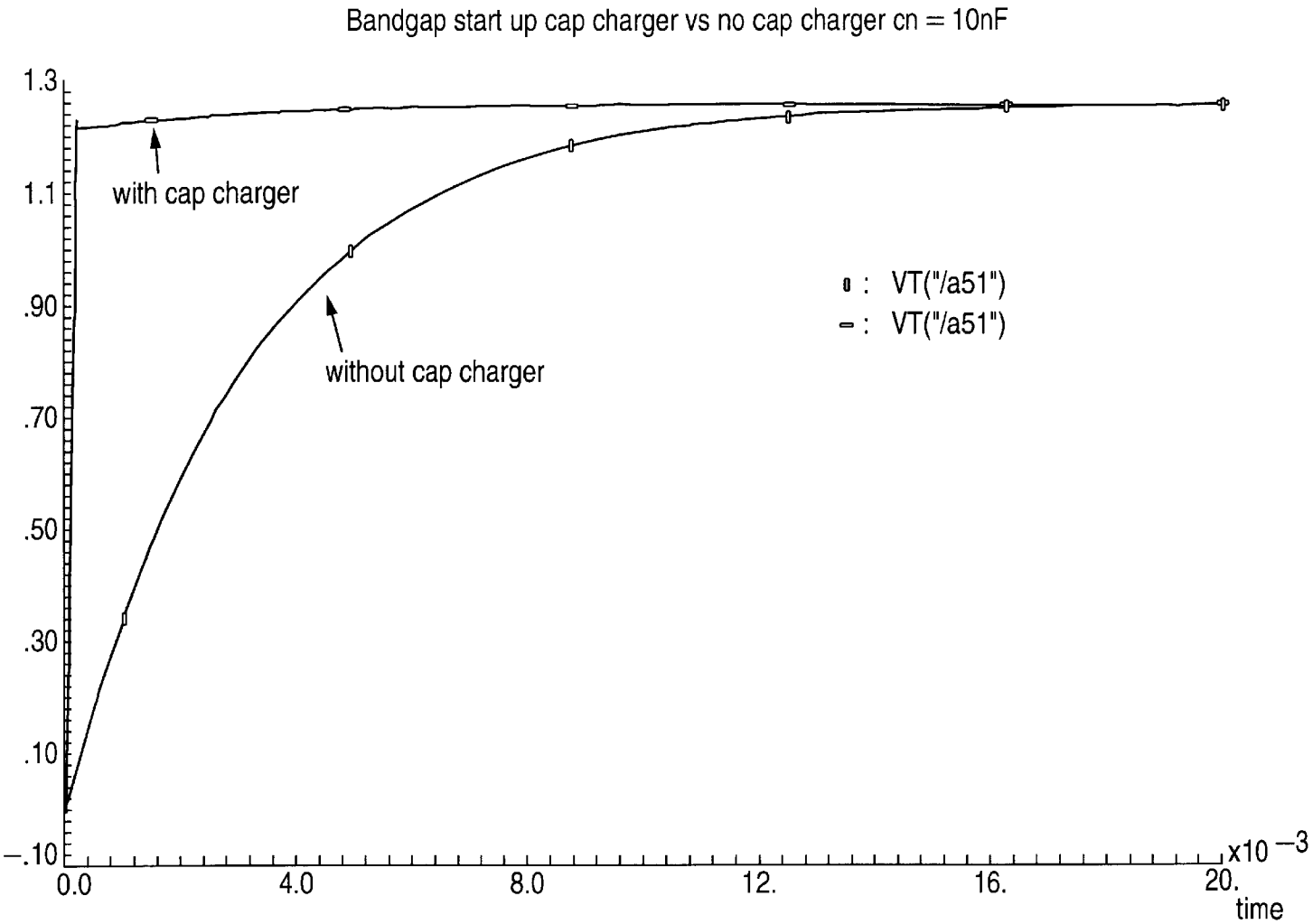
FIG. 7 is a graph of voltage versus time for the output voltage of the present invention, compared to the output voltage of a prior art band-gap circuit.

A graph of the voltages Vbgi, Vd and Vbgo is shown in FIG. 5. When the circuit receives power, Vbgi and Vd reach their steady state values very quickly and the cap charger circuit is operational. The value of Vbgo increases until it reaches Vd, at which point the cap charger circuit is turned off. The value of Vbgo continues to increase until it equals Vbgi. The value of Vbgo reaches 95% of its steady state value much more quickly than a band-gap output connected solely to a capacitor. This is illustrated in FIG. 7. For a conventional band-gap circuit, it takes approximately 20 milliseconds for the output voltage to reach steady state with a 10 nF capacitor. As stated above, this time is much too long to allow the circuit to be routinely powered down to conserve power. With the present invention, the filtered output of the band-gap circuit reaches 95% of its final value within 200 microseconds. This allows the voltage regulator circuit, or other connected circuitry, to be switched off and on at will in order to conserve power, without disrupting the operation of the host system.

Figure 8:
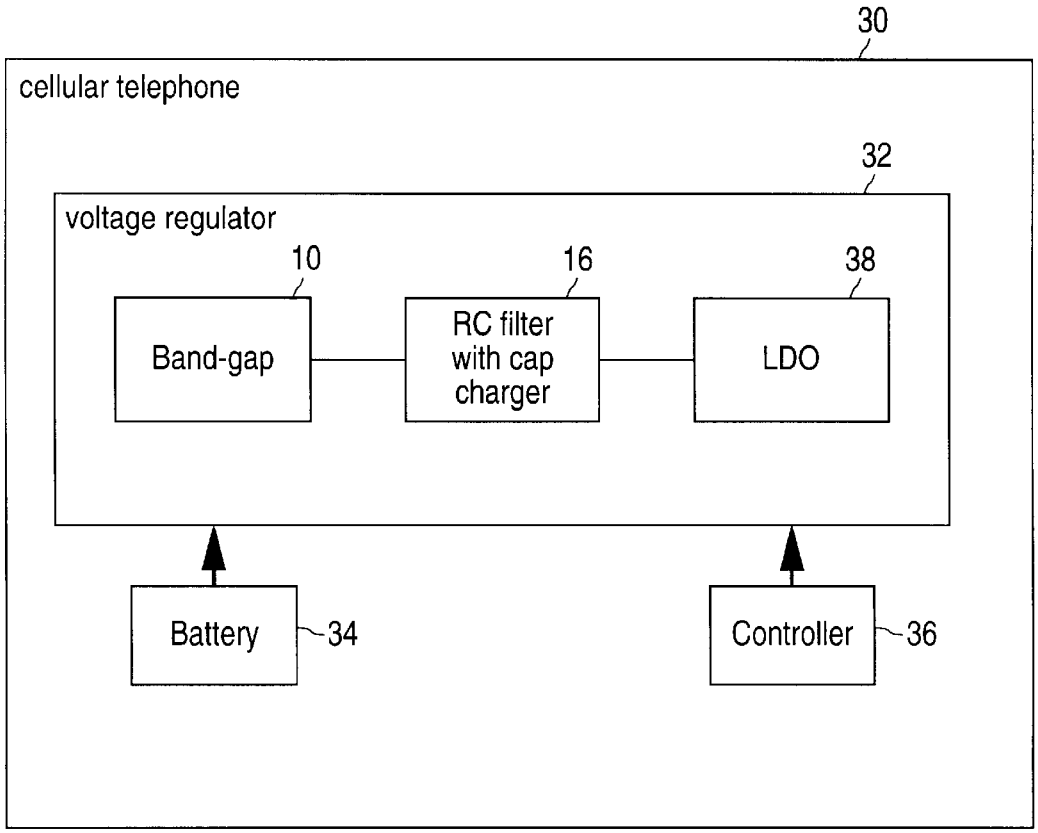
FIG. 8 is a block diagram of a cellular telephone incorporating the present invention.

A block diagram of a cellular telephone 30 incorporating the present invention is shown in FIG. 8. If the voltage regulator 32 is configured according to the present invention, the cellular telephone controller 36 can periodically shut down the regulator 32 and the rest of the circuit in order to conserve the battery 34. Since the turn-on time is so short (less than 200 microseconds), the regulator 32 and the rest of the circuit can be powered back up without any significant wait time. Furthermore, the present invention is suitable for use in CMOS or Bi-CMOS processes, and therefore can provide an inexpensive and low-power voltage regulator solution.

Those skilled in the art will appreciate that various adaptations and modifications of the just-described preferred embodiments can be configured without departing from the scope and spirit of the invention. Therefore, it is to be understood that, within the scope of the appended claims, the invention may be practiced other than as specifically described herein.

What is claimed is:

1. A band-gap filter circuit comprising:

an input node connected to an output of a band-gap circuit;

an output node;

an RC filter, wherein the RC filter comprises:

a first resistor connected between the input and output nodes; and a capacitor connected between the output node and a circuit ground;

a capacitor charger circuit connected to the RC filter, wherein the capacitor charger circuit comprises:

a comparator having a first and a second input terminal, and an output terminal, wherein the first input terminal is connected to the input node and the second input terminal is connected to the output node; and a transistor connected to the output terminal of the comparator and to the RC filter;

a current source connected to the transistor, such that the output of the comparator connects to a controlling gate of the transistor and when the transistor is turned on, current from the current source is electrically connected to the RC filter; and a second resistor connected between the input node and the first input terminal of the comparator.

2. The circuit of claim 1, further comprising a third resistor connected to the second resistor.

3. The circuit of claim 2, further comprising a second transistor connected between the third resistor and the circuit ground.

4. The circuit of claim 3, further comprising a second current source connected to the input node.

5. The circuit of claim 1, wherein the capacitor is a 10 nF capacitor.

6. The circuit of claim 1, wherein the voltage at the first input terminal is a predetermined value less than the voltage at the input node.

7. The circuit of claim 6, wherein the predetermined value is 40 millivolts.

8. A method for filtering an output voltage of a band-gap circuit, the method comprising:

isolating a filter capacitor from an output of the band-gap circuit;

charging the filter capacitor with a charging circuit; and stopping the charging circuit once the filtered output voltage is equal to the output voltage of the band-gap circuit, wherein the charging circuit is stopped once the filtered output voltage reaches a predetermined value, wherein the predetermined value is 40 millivolts less than the output voltage of the band-gap circuit.

9. A voltage regulator circuit comprising:

a band-gap circuit;

an RC filter circuit connected to an output of the band-gap circuit;

a capacitor charger circuit connected to the RC filter circuit; and a low dropout voltage regulator circuit connected to the RC filter circuit.

10. The voltage regulator circuit of claim 9, wherein the capacitor charger circuit comprises a comparator and a transistor switch.

11. The voltage regulator circuit of claim 10, wherein the capacitor charger circuit further comprises a current source.

12. The voltage regulator circuit of claim 11, wherein the circuit is manufactured in CMOS.

13. A cellular telephone comprising:

a controller;

a battery; and a voltage regulator circuit comprising:

a band-gap circuit;

an RC filter circuit connected to an output of the band-gap circuit;

a capacitor charger circuit connected to the RC filter circuit; and a low drop-out voltage regulator circuit connected to the RC filter circuit;

wherein the cellular telephone conserves battery power by periodically turning off the voltage regulator circuit.

* * * * *